US005789354A

United States Patent [19]

Mikami et al.

[11] Patent Number: 5,789,354

[45] Date of Patent: Aug. 4, 1998

[54] LUBRICATIVE COMPOSITION

[75] Inventors: Hidenobu Mikami, Kuwana; Mitsunari Asao, Suzuka, both of Japan

[73] Assignee: NTN Corporation, Japan

[21] Appl. No.: 760,965

[22] Filed: Dec. 5, 1996

[30] Foreign Application Priority Data

Aug. 9, 1996 [JP] Japan ..... 8-211097

[51] Int. Cl.[6] ..... C10M 139/04

[52] U.S. Cl. ..... 508/201; 508/107; 508/204

[58] Field of Search ..... 508/107, 201, 508/204, 215; 428/308.4

[56] References Cited

U.S. PATENT DOCUMENTS

| | | | |
|---|---|---|---|
| 3,821,112 | 6/1974 | Korshak et al. | 508/201 |
| 3,985,661 | 10/1976 | Ikeda et al. | 508/107 |
| 4,378,389 | 3/1983 | Maruyama et al. | 508/201 |

FOREIGN PATENT DOCUMENTS 633071 11/1994 Japan .

*Primary Examiner*—Jacqueline V. Howard
*Assistant Examiner*—Cephia D. Toomer
*Attorney, Agent, or Firm*—Wenderoth, Lind & Ponack, L.L.P.

[57] ABSTRACT

A lubricative composition which can retain lubricating oil or grease without degrading it, which is heat-resistant and mechanically strong, and can be used continuously for a much longer time than conventional ones without the possibility of shortage of lubricant supply. It includes a first component, which is a modified silicone oil having reactive organic groups, a second component, which is a curing agent having organic groups that react with the reactive organic groups, and a third component, which is a lubricating oil or grease. The third component is retained in a three-dimensionally reticulated structure of silicone formed by polymerizing the first and second components in the third component. The third component has no compatibility with either the first or second components. The lubricating oil or grease retained in the lubricative composition can ooze out through the pores that communicate with each other onto the surface of the lubricative composition, so that the composition will exhibit lubricating properties stably for a long period of time. By adding a high-viscosity synthetic hydrocarbon oil to the base oil of the lubricating oil or grease, it is possible to positively prevent separation of oil during hardening.

13 Claims, 3 Drawing Sheets

LUBRICATIVE COMPOSITION

BACKGROUND OF THE INVENTION

This invention relates to a lubricative composition, especially one which can be used as a lubricant for a bearing used at high temperatures.

Lubricative compositions such as lubricating oil or grease are applied to or charged in parts of bearings and other machine components where lubrication is needed.

Such lubricative compositions are liquid or semisolid and thus are liable to splash under centrifugal and gravitational forces while the machine components are in operation. Therefore, such lubricants are ordinarily sealed in sealing members.

Unexamined Japanese Patent Publication 55-137198 proposes to add polyethylene to lubricating grease to provide a solidified lubricative composition that needs no sealing members.

But such a polyethylene-solidified lubricative composition cannot be used at temperatures higher than 120° C. because polyethylene's melting point is so low that it begins to soften at around 120° C. and melts completely at 130°–140° C.

In order to solidify lubricating oil or grease by adding a thermoplastic resin, the lubricant, as well as the resin, has to be heated to a temperature higher than the melting point of the resin. Heating may degrade the lubricating properties of the lubricant and the strength of the bearing and other machine components.

The melting temperature of the above lubricative composition will be 180°–200° C. if it contains polyamide as a thermoplastic resin, 170°–190° C. if it contains polypropylene, and 220°–250° C. if it contains polymethyl pentane. In any case, the lubricating oil or grease has to be heated to temperatures higher than 180° C., i.e. temperatures that can degrade the lubricating oil or grease.

In Unexamined Japanese Patent Publication 6-330071, a lubricative composition which solidifies at a relatively low temperature is disclosed. It comprises a substrate containing a curable silicone rubber, and silicone oil, which has a compatibility with silicone, or silicone oil-based grease retained in the substrate.

This lubricative composition is highly heat-resistant and solidifies at a relatively low temperature, i.e. lower than 100° C. It is thus possible to prevent degradation of the lubricating oil and the bearings and other machine parts.

Such a conventional lubricative composition, comprising a substrate containing a curable silicone rubber and silicone oil retained in the substrate, has a three-dimensionally reticulated structure formed with extremely fine pores that are not in communication with each other. Thus, oil or grease tends to be confined in these pores without coming out onto the surface of the lubricative composition. Since a sufficient amount of oil or grease can not ooze out onto the surface, problems resulting from poor lubrication tend to occur when the machine parts are operated continuously for e.g. over 100 hours.

It is not easy to control the functional group equivalent of reactive organic groups incorporated in the curable silicone. If the functional group equivalent is too small, the composition tends to be too brittle and hard. If it is too large, the composition tends to be too soft like rubber. It is thus difficult to stabilize the properties of the composition.

An object of this invention is to provide a lubricative composition which is free of these problems, which can retain lubricating oil or grease without degrading it, which is heat-resistant and mechanically strong, and can be used continuously for a much longer time than conventional lubricative compositions without the possibility of poor lubrication.

SUMMARY OF THE INVENTION

According to this invention, there is provided a lubricative composition comprising a first component which is a modified silicone oil having reactive organic groups, a second component which is a curing agent having organic groups that react with the reactive organic groups, and a third component which is a lubricating oil or grease, the third component being retained in a three-dimensionally reticulated structure of silicone formed by polymerizing the first component and the second component in the third component, the third component having no compatibility with either the first component or the second component.

The functional group equivalent of the reactive organic groups of the first or second component is set at 50–5000 g/mol.

From another aspect of the invention, there is provided a lubricative composition comprising a fourth component, which is a modified silicone oil having reactive organic groups and other organic groups that react with the reactive organic groups, and a third component, which is a lubricating oil or grease, the third component being retained in a three-dimensionally reticulated structure of silicone formed by polymerizing the fourth component in the third component, the third component having no compatibility with the fourth component.

The functional group equivalent of the reactive organic groups of the fourth component is set at 50–5000 g/mol.

Since the third component has no compatibility with silicone, the three-dimensionally reticulated structure has larger pores for retaining the third component, i.e. lubricating oil or grease, than in the arrangement in which the third component has a compatibility with silicone. Moreover, such pores communicate with each other.

Thus, the lubricating oil or grease retained in the pores of the reticulated structure can more easily ooze out on the surface of the composition, thus lubricating machine parts stably for a long period of time.

Separation (bleeding) of oil may occur while forming (curing) the lubricative composition due to lack of compatibility of the third component with silicone. But the amount of oil separated is negligibly small compared with the oil content. Thus, such separation can be limited to an amount that will do no actual harm by carrying out the mixing and curing steps in a sufficiently short time or by sealing the interior of the bearing.

It is possible to more positively prevent such separation by forming the third component i.e. lubricating oil or grease from a mixture of a base oil which is at least one oil selected from the group consisting of mineral oil, synthetic hydrocarbon oil, ester oil, ether oil, fluorine oil and phosphate ester oil, and a high-viscosity synthetic hydrocarbon oil having a viscosity of 1000 cSt at 40° C. and added to the base oil. The high-viscosity synthetic hydrocarbon oil is preferably a carboxy-modified synthetic hydrocarbon oil.

Since the silicone oil is polymerized at 180° C. or lower, preferably between room temperature and about 150° C., there is no possibility of degradation of the lubricating component and the machine parts to which the lubricative composition is applied. The lubricating composition formed will reveal high heat resistance, which is largely attributable to silicone, and other desirable physical properties.

Other features and objects of the present invention will become apparent from the following description made with reference to the accompanying drawings, in which:

DETAILED DESCRIPTION OF THE PREFERRED EMBODIMENT

Figure 1:
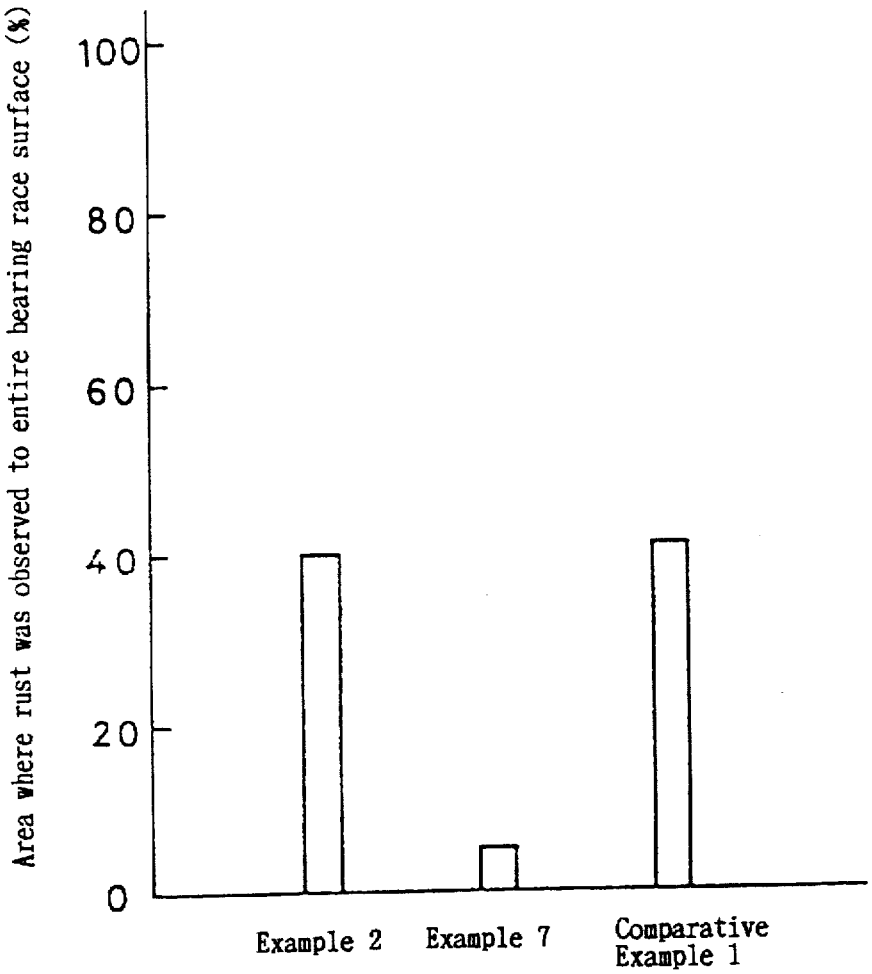
FIG. 1 is a graph showing the rate of the area where rusting was observed to the entire surface area of the inner periphery of the bearing in the Examples and the Comparative Examples.

The modified silicone oil having reactive organic groups used in this invention, which is the first component, is a silicone oil having reactive organic groups in its molecules. It polymerizes and forms a three-dimensionally reticulated structure when a curing agent, which is the second component, having organic groups that react with the above said reactive organic groups is added thereto.

The modified silicone oil used in this invention may be any known modified silicone oil in which amino groups, epoxy groups, hydroxy groups, mercapto groups or carboxy groups are attached to the side chains or chain ends of silicone.

Any modified silicone oil may be combined with any curing agent provided their reactive organic groups react with each other. Also, either of the silicone oil and curing agent may have either of two organic groups selected to form a combination. For example, if a combination of amino groups and epoxy groups is selected, an amino-modified silicone oil may be combined with an epoxy curing agent, or an epoxy-modified silicone oil may be combined with an amine curing agent.

Preferable combinations of reactive organic groups in the modified silicone oil and the curing agent include combinations of hydroxyl groups and isocyanate groups; hydroxyl groups and carboxyl groups; hydroxyl groups and epoxy groups; amino groups and isocyanate groups; amino groups and carboxyl groups; and amino groups and epoxy groups.

Part of the modified silicone oil other than the reactive organic groups may be replaced with a metal. For example, by using a metasiloxane in which part of silicone is replaced with such a metal as aluminum or titanium, a composition having improved heat resistance will be obtained.

Preferred compounds having the abovementioned epoxy groups for use as the curing agent include bisphenol type epoxy compounds and cyclic aliphatic epoxy compounds. Bisphenol type epoxy compounds include reactants of bisphenol A with epichlorohydrine. Commercially available bisphnol type epoxy compounds include Epikote 825, 827, 828, 834, 815 made by Yuka Shell Epoxy. Commercially available reactants of bisphenol F and epichlorohydrine include Epikote 807 made by Yuka Shell Epoxy.

Cyclic aliphatic epoxy compounds include alicyclic diepoxy acetal (CY175 by CIBA-GEIGY), alicyclic diepoxy adipate (CY177), alicyclic diepoxy carboxylate (CY179), vinylcyclohexene dioxide, diglycidyl phthalate, diglycidyl tetrahydrophthalate, diglycidyl hexahydrophthalate, dimethylglycidyl phthalate, dimethylglycidyl hexahydrophthalate, Dimer acid glycidyl ester, modified Dimer acid glycidyl ester, aromatic diglycidyl ester, and cycloaliphatic diglycidyl ester.

Lubricating oil used in this invention is an oil having no compactibility with silicone. For example, it may be mineral oil, synthetic hydrocarbon oil, diester oil, polyol ester oil, ether oil, fluorine oil, phosphate ester oil, or other lubricating oil other than silicone oil, or a mixture thereof.

Grease used in the invention may be made by adding a thickening agent such as a metallic soap or a non-soap agent (such as diurea, benton, polyurea, etc.) to any of the above lubricating oils as a base oil to increase its viscosity to a desired level. If necessary, other additives including extreme pressure agents may be added. Greases (which are combinations of thickening agent with base oil pairs) that can be used in this invention are listed below:

lithium soap with diester oil, lithium soap with mineral oil, lithium soap with synthetic hydrocabon, sodium soap with mineral oil, aluminum soap with mineral oil, lithium soap with diester mineral oil, non-soap with diester oil, non-soap with mineral oil, non-soap with polyol ester oil, non-soap with ether oil, non-soap with synthetic hydrocarbon, lithium soap with polyol ester oil High-viscosity synthetic hydrocarbon oil added to the base oil of the grease or the lubricating oil may be a high-viscosity hydrocabon oil having a viscosity of 1000 cSt or more at 40° C. If its viscosity at 40° C. is less than 1000 cSt, it will be difficult to prevent separation of its components due to non-compatibility of its third component with silicone.

Such high-viscosity synthetic hydrocarbon oil should be added to the base oil or the lubricating oil preferably in the amount of 1 to 10% by weight. If this amount is less than 1% by weight, the third component will not show sufficient compatibility with silicone. Best results were achieved at the range of 4–6% by weight.

Carboxy-modified synthetic hydrocarbon oil is a synthetic hydrocarbon oil having carboxyl groups incorporated in to its portion. Among commercially available such oils are LUCANT A-5202, A-6002, A-5215, A-5515, A-5260, A-5560, A-5320H made by Mitsui Petrochemical Industry.

In order to further improve the lubricating properties and strength of the lubricative composition of this invention, the following substances may be further added: mineral powders such as calcium carbonate, talc, silica, clay and mica; inorganic fibers such as glass fiber, asbestos, quartz wool, carbon fiber and metallic fiber; nonwoven and woven fabrics made from these fibers; organic fibers such as aromatic polyamide fibers (alamide fibers) and polyester fibers; polyethylene, polypropylene, polyimide, polybenzoimidazole, or other thermosetting and thermoplastic resins.

Also, in order to improve necessary physical properties of the lubricative composition of this invention according to its intended use, the following substances may be further added: fatty metallic salts, known antioxydants, rust preventives, oiliness improvers, wear resistance improvers, extreme pressure agents, solid lubricants, crosslinking accelerators, curing catalyst, organic colorants and inorganic colorants.

EXAMPLES

Modified silicone oils, curing agents, and reactive organic groups used in the Examples and the Comparative Examples are listed below. Their contents are shown in Tables 1–3.

(1) amino-modified silicone oil (BY16–849 by Toray Dow Corning: functional group equivalent: 600 g/mol)

(2) amino-modified silicone oil (KF861 by Shinetsu Silicon: functional group equivalent: 2000 g/mol)

(3) epoxy-modified silicone oil (KF101 by Shinetsu Silicone: functional group equivalent: 4000 g/mol)

(4) epoxy-modified silicone oil (KF100T by Shinetsu Silicone: functional group equivalent: 350 g/mol)

(5) cyclic aliphatic epoxy (diglycidyltetrahydro phthalate) (Araldite CY182 by CIBA-GEIGY, Functional group equivalent: 160 g/mol, having the structure expressed by the following formula)

FORMULA 1

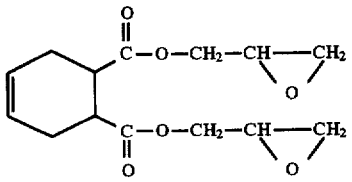

(6) bisphenol type epoxy (Epikote 828 by Yuka Shell Epoxy, functional group equivalent: 190 g/mol)

(7) bisphenol type epoxy (Epikote 807 by Yuka Shell Epoxy, functional group equivalent: 170 g/mol)

(8) ethylenediamine (by Wako Pure Chemical Industries, Ltd.)

(9) p-phenylenediamine (by Wako Pure Chemical Industries, Ltd.)

(10) high-viscosity hydrocarbon oil (LUCANT HC-2000 by Mitsui Petrochemical Co.)

(11) carboxy-modified synthetic hydrocarbon oil (LUCANT A-5260 by Mitsui Petrochemical Co.

EXAMPLE 1

25% by weight of amino-modified silicone oil, 25% by weight of cyclic aliphatic epoxy, and 50% by weight of lithium soap with mineral oil grease were uniformly blended together at normal temperature. About 1.8 grams of the composition thus obtained was charged into a 6204 ball bearing and hardened by holding it at 150° C. for 30 minutes. Then, the ball bearing was rotated at 5000 rpm at 150° C. Its lubricating properties were evaluated by measuring the time elapsed until the input current used for the motor to drive the rotary shaft exceeds a limit current (i.e. until the turning torque exceeds twice the starting torque). The elapsed time was 200 hours.

About 1.8 grams of the above composition was charged into a 6204 ball bearing and hardened by holding it for 30 minutes at 150° C. Then, the ball bearing was operated at 1800 rpm at 25° C. During operation, it was checked whether or not the bearing is producing any abnormal sounds (The same test was conducted for all the Examples 1–7 and Comparative Example 1). X and ○ in Tables 1 and 2 indicate that the bearing produced abnormal sounds and produced no such sounds, respectively.

EXAMPLE 2

35% by weight of amino-modified silicone oil, 15% by weight of cyclic aliphatic epoxy, and 50% by weight of urea-synthetic hydrocarbon grease were uniformly blended together at normal temperature. About 1.8 grams of the composition thus obtained was charged into a 6204 ball bearing and hardened by holding it at 150° C. for 30 minutes. Then, the ball bearing was rotated at 5000 rpm at 150° C. to evaluate the lubricating properties of the composition in the same way as in Example 1. It was possible to rotate the bearing for 700 hours.

A bearing of the above type in which the above lubricative composition was charged and hardened was subjected to a rusting test. In this test, 0.5 milliliter of 3% salt water was injected into the ball bearing. After leaving the bearing for 100 hours at 40° C., the bearing was observed to measure the area ratio (%) of the surface where rust developed to the entire bearing raceway surface. The results of measurement are shown in FIG. 1.

Figure 2:
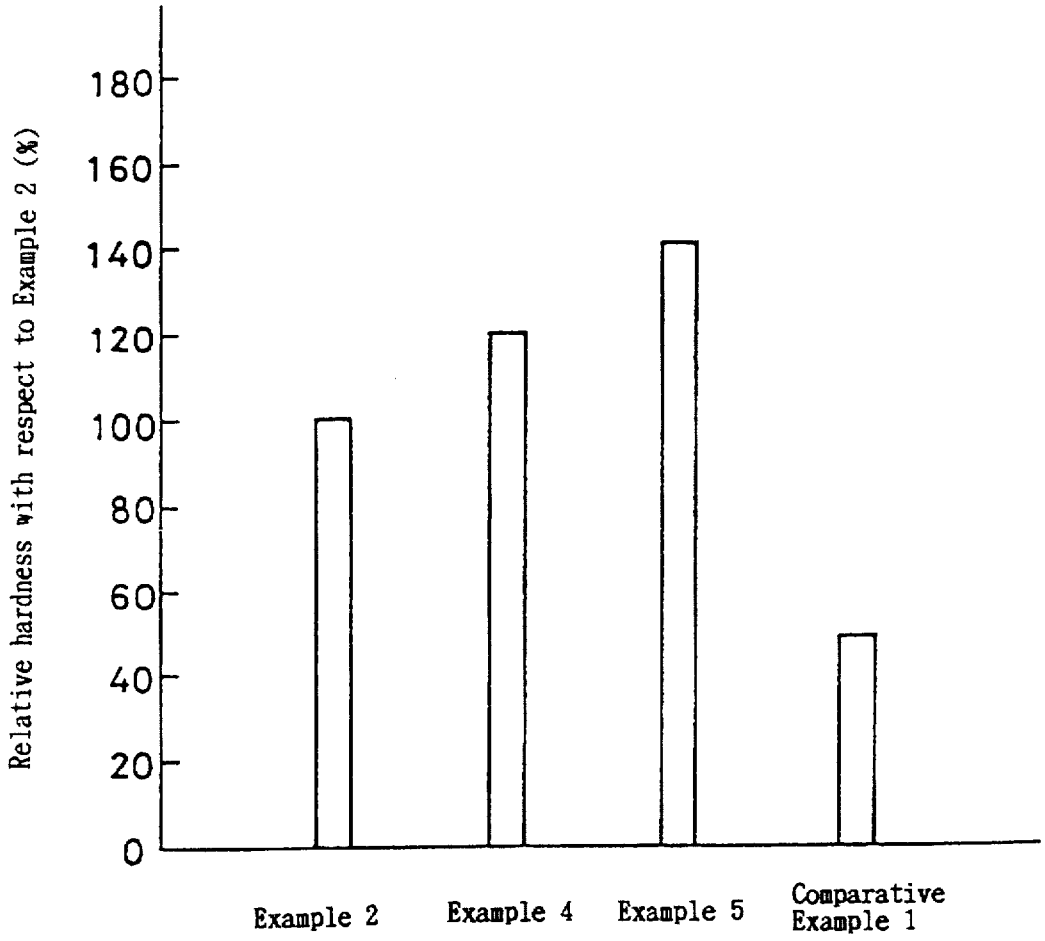
FIG. 2 is a graph showing the relative hardness of the Examples and the Comparative Examples.

Further, in order to determine the relative hardness of each lubricative composition obtained, its hardness was measured with a ASKER Type C hardness tester. The results are shown in FIG. 2, in which the hardness of each test piece is given in percent relative to the hardness of Example 2.

EXAMPLE 3

40% by weight of amino-modified silicone oil, 10% by weight of cyclic aliphatic epoxy, and 50% by weight of urea-ether grease were uniformly blended together at normal temperature. About 1.8 grams of the composition thus obtained was charged into a 6204 ball bearing and hardened by holding it at 150° C. for 30 minutes. Then, the ball bearing was rotated at 5000 rpm at 150° C. to evaluate the lubricating properties of the composition in the same way as in Example 1. It was possible to rotate the bearing for 1200 hours.

EXAMPLE 4

34.5% by weight of amino-modified silicone oil, 13.5% by weight of cyclic aliphatic epoxy, 50% by weight of urea-synthetic hydrocarbon grease, and 2% by weight of lithium stearate were uniformly blended together at normal temperature. The composition thus obtained was hardened by holding it at 150° C. for 30 minutes. The hardness of the composition was then measured in exactly the same way as in Example 2. The results of measurement are shown in FIG. 2.

1.8 grams of the above composition was charged into a 6204 ball bearing and hardened by holding it at 150° C. for 30 minutes. Then, the ball bearing was rotated at 5000 rpm at 150° C. to evaluate the lubricating properties of the composition in the same way as in Example 1. It was possible to rotate the bearing for 700 hours.

EXAMPLE 5

26.0% by weight of amino-modified silicone oil, 13.0% by weight of cyclic aliphatic epoxy, 60% by weight of urea-synthetic hydrocarbon grease, and 1% by weight of calcium stearate were uniformly blended together at normal temperature. The composition thus obtained was hardened by holding it at 150° C. for 30 minutes.

The hardness of the composition was then measured in exactly the same way as in Example 2. The results of measurement are shown in FIG. 2.

1.8 grams of the above composition was charged into a 6204 ball bearing and hardened by holding it at 150° C. for 30 minutes. Then, the ball bearing was rotated at 5000 rpm at 150° C. to evaluate the lubricating properties of the composition in the same way as in Example 1. It was possible to rotate the bearing for 700 hours.

EXAMPLE 6

34.5% by weight of amino-modified silicone oil, 14.5% by weight of cyclic aliphatic epoxy, 50% by weight of urea-synthetic hydrocarbon grease, and 1% by weight of molybdenum disulfide (solid lubricant) were uniformly blended together at normal temperature. 1.8 grams of the composition thus obtained was charged into a 6204 ball bearing and hardened by holding it at 150° C. for 30 minutes. Then, the ball bearing was rotated at 5000 rpm at 150° C. to evaluate the lubricating properties of the composition in the same way as in Example 1. It was possible to rotate the bearing for 500 hours.

EXAMPLE 7

34.5% by weight of amino-modified silicone oil, 13.5% by weight of cyclic aliphatic epoxy, 50% by weight of urea-synthetic hydrocarbon grease, and 2% by weight of ester rust preventive were uniformly blended together at normal temperature, and hardened by holding it at 150° C. for 30 minutes.

This lubricative composition was charged into a ball bearing of the above type, and the bearing was subjected to the same rusting test as in Example 2. The results are shown in FIG. 1.

1.8 grams of the above composition was charged into a 6204 ball bearing and hardened by holding it at 150° C. for 30 minutes. Then, the ball bearing was rotated at 5000 rpm at 150° C. to evaluate the lubricating properties of the composition in the same way as in Example 1. It was possible to rotate the bearing for 500 hours.

COMPARATIVE EXAMPLE 1

35% by weight of amino-modified silicone oil, 15% by weight of cyclic aliphatic epoxy, and 50% by weight of lithium soap with silicone oil grease were uniformly blended together at normal temperature. 1.8 grams of the composition thus obtained was charged into a 6204 ball bearing and hardened by holding it at 150° C. for 30 minutes. Then, the ball bearing was rotated at 5000 rpm at 150° C. to evaluate the lubricating properties of the composition in the same way as in Example 1 of the invention. In 100 hours, it became impossible to rotate the bearing.

This lubricative composition was charged into a ball bearing of the above type, and the bearing was subjected to the same rusting test as in Example 2. The results are shown in FIG. 1.

Further, the hardness of the lubricative composition obtained was measured in exactly the same way as in Example 2. The result of measurement are shown in FIG. 2.

EXAMPLE 8–15 AND COMPARATIVE EXAMPLES 2 AND 3

Predetermined components were added in the amounts shown in Tables 2 and 3 and uniformly blended together at normal temperature and the compositions obtained were hardened by holding them at 150° C. for 30 minutes.

1.8 grams of each of these compositions were charged into a 6204 ball bearing and hardened by holding it for 30 minutes at 150° C. The ball bearing was then rotated at 1800 rpm at 25° C. During operation, it was checked whether or not the bearing is producing any abnormal sounds. X and ○ in Tables 1 and 2 indicate that the bearing produced abnormal sounds and produced no such sounds, respectively.

For Examples 2, 14 and 15, the lubricative composition was charged into a cylindrical mold (5 mm in radius and 8 mm high) and hardened by holding it for 30 minutes at 150° C. to form a cylindrical test piece. For each test piece, the weight of synthetic hydrocarbon oil that has oozed out from the resin composition during hardening was measured. The relative weight values in FIG. 3 are in percentage relative to the weight value in Example 2, which is 100.

Figure 3:
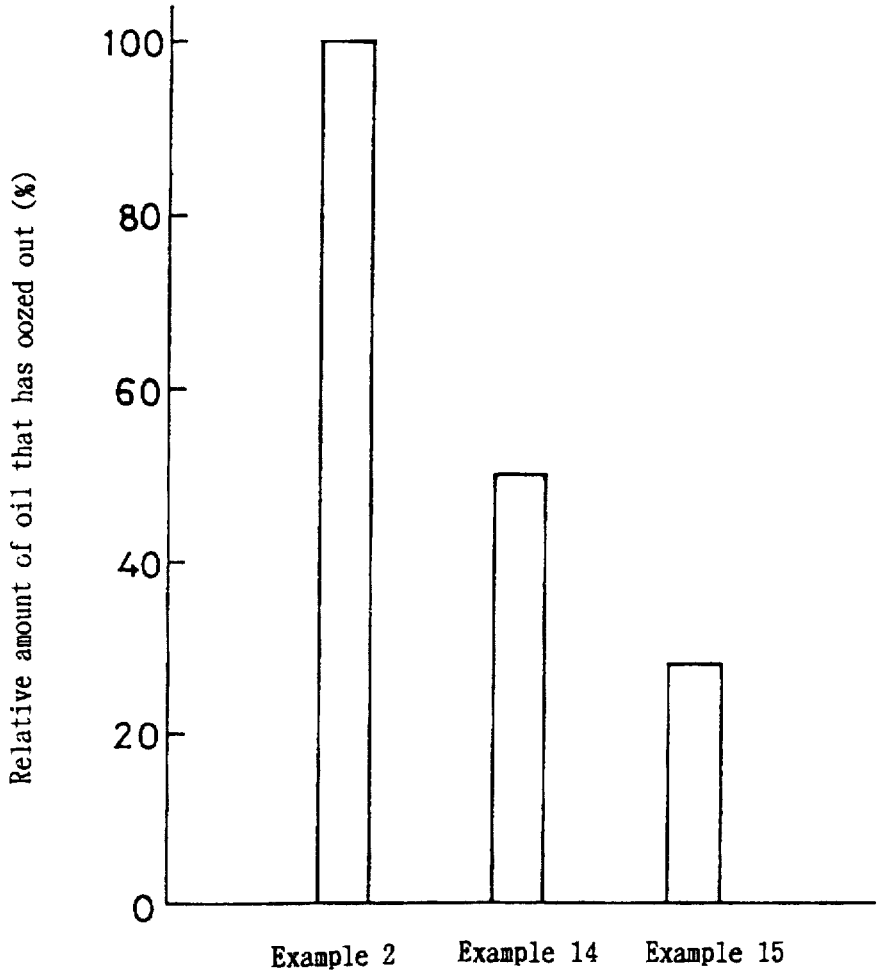
FIG. 3 is a graph showing the relative amounts of oil that oozes out on the surface while forming the Examples.

As will be apparent from FIGS. 1–3,for Comparative Examples 2 and 3, in which the total amount of the modified silicone oil and the compound having reactive organic groups was either less than or over the predetermined range, the lubricative composition was either unhardened or hardened excessively. In the latter case, the bearing produced abnormal sounds.

In contrast, for Examples 8 and 9, in which the total amount of the modified silicone oil and the compound having reactive organic group was within the predetermined range, the hardness of the composition was proper and the bearing produced no abnormal sounds.

Also, as is apparent from FIG. 1 for the composition of Example 7, which contains a rust preventive, the rusting rate reduced to about ⅕, compared with Example 2, which contained no rust preventive, and Comparative Example 1.

As shown in FIG. 2, the lubricative compositions of Examples 2, 4 and 5 is sufficiently hard and thus of high strength compared with Comparative Example 1, in which is used a lubricating oil having a compatibility with the three-dimensionally reticulated structure.

Further, as shown in FIG. 3, compared with Example 2 which contained no high-viscosity hydrocarbon oil, the amount of oil that oozed out was fairly small in Examples 14 and 15, in which a high-viscosity hydrocarbon oil was added by 5% by weight.

As described above, the lubricative composition according to this invention has a three-dimensionally reticulated structure of silicone which is formed by polymerizing a modified silicone oil in a lubricating oil or grease having no compatibility with the silicone oil and in which is kept the lubricant. Such a composition can be manufactured without the need to heat it to high temperatures, so that the lubricating oil or grease will never degrade. Also, since its shape is retained by the heat-resistant silicone, it can be used continuously for a much longer time than conventional lubricative compositions without the possibility of shortage of lubricant supply.

By setting the functional group equivalent of the reactive organic groups contained in the predetermined component within the predetermined range, it is possible to improve the mechanical strength of the composition.

By adding a high-viscosity synthetic hydrocarbon oil to a lubricating oil or grease as the base oil, it is possible to positively prevent separation of oil during hardening of the composition.

TABLE 1

| | Examples | | | | | | |
|---|---|---|---|---|---|---|---|
| Number | 1 | 2 | 3 | 4 | 5 | 6 | 7 |
| Component | | | | | | | |
| Amino-modified silicone oil (1) | 25.0 | 35.0 | 40.0 | 34.5 | 26.0 | 34.5 | 34.5 |
| Cyclic aliphatic epoxy (5) | 25.0 | 15.0 | 10.0 | 13.5 | 13.0 | 14.5 | 13.5 |
| Li soap-mineral oil grease | 50.0 | — | — | — | — | — | — |

TABLE 1-continued

| Number | Examples 1 | 2 | 3 | 4 | 5 | 6 | 7 |
|---|---|---|---|---|---|---|---|
| Component | | | | | | | |
| Urea-synthetic hydrocarbon grease | — | 50.0 | — | 50.0 | 60.0 | 50.0 | 50.0 |
| Urea-ether grease | — | — | 50.0 | — | — | — | — |
| Lithium stearate | — | — | — | 2.0 | — | — | — |
| Calcium stearate | — | — | — | — | 1.0 | — | — |
| Molybdenum disulfide | — | — | — | — | — | 1.0 | — |
| Ester series rust preventive | — | — | — | — | — | — | 2.0 |
| Hardness (Askar C) | 82 | 63 | 75 | 78 | 85 | 83 | 72 |
| Abnormal noise | ○ | ○ | ○ | ○ | ○ | ○ | ○ |

TABLE 2

| Number | Examples 8 | 9 | 10 | 11 | 12 | 13 | 14 | 15 |
|---|---|---|---|---|---|---|---|---|
| Component | | | | | | | | |
| Amino-modified silicone oil (1) | — | — | — | — | 34.5 | 34.5 | 35.0 | 35.0 |
| Amino-modified silicone oil (2) | — | — | 42.0 | — | — | — | — | — |
| Epoxy-modified silicone oil (4) | 27.0 | 32.0 | — | 54.0 | — | — | — | — |
| Cyclic aliphatic epoxy (5) | — | — | 8.0 | — | — | — | 15.0 | 15.0 |
| Bisphenol type epoxy (6) | 3.0 | 4.0 | — | — | 13.5 | — | — | — |
| Bisphenol type epoxy (7) | — | — | — | 12.0 | — | 13.5 | — | — |
| Ethylene-diamine (8) | 3.0 | 4.0 | — | — | — | — | — | — |
| p-phenylene-diamine (9) | — | — | — | 12.0 | — | — | — | — |
| Li soap-mineral oil grease | 70.0 | 64.0 | — | 34.0 | — | — | — | — |
| Urea-synthetic hydrocarbon grease | — | — | 50.0 | — | 50.0 | 50.0 | 45.0 | 45.0 |
| High-viscosity hydrocarbon oil (10) | — | — | — | — | — | — | 5.0 | — |
| High-viscosity hydrocarbon oil (11) | — | — | — | — | — | — | — | 5.0 |
| Hardness (Askar C) | 60 | 80 | 43 | 80 | 74 | 82 | 70 | 65 |
| Abnormal noise | ○ | ○ | ○ | ○ | ○ | ○ | ○ | ○ |

| Number | Comparative Examples 1 | 2 | 3 |
|---|---|---|---|
| Component | | | |
| Amino-modified silicone oil (1) | 35.0 | — | — |
| Epoxy-modified silicone oil (3) | — | 16.0 | — |
| Epoxy-modified silicone oil (4) | — | — | 50.0 |
| Cyclic aliphatic epoxy (5) | 15.0 | — | — |
| Ethylenediamine (8) | — | 1.0 | — |
| p-phenylenediamine (9) | — | — | 40.0 |
| Li soap-mineral oil grease | — | 83.0 | 10.0 |
| Urea-synthetic hydrocarbon grease | — | — | — |

-continued

| Number | Comparative Examples 1 | 2 | 3 |
|---|---|---|---|
| Urea-ether grease | — | — | — |
| Li soap-silicone grease | 50 | — | — |
| Hardness (Askar C) | 30 | Unhard-ened | 90 |
| Abnormal noise | — | ○ | X |

What is claimed is:

1. A lubricative composition comprising a first component which is a modified silicone oil having reactive organic groups, a second component which is a curing agent having organic groups that react with said reactive organic groups, and a third component which is a lubricating oil or grease, said third component being retained in a three-dimensionally reticulated structure of silicone formed by polymerizing said first component and said second component in said third component, said third component having no compatibility with either said first component or said second component.

2. The lubricative composition as claimed in claim 1 wherein the total amount of said first and second components is 20–80% by weight of the total weight of said lubricative composition, and wherein the weight ratio of said first component to said second component is from 10:1 to 1:10.

3. The lubricative composition as claimed in claim 1 wherein the chemical equivalent of the reactive organic groups of said first or second component is 50–5000 g/mol.

4. The lubricative composition as claimed in claim 1 wherein said first component is an amino-modified silicone oil, and said second component is an epoxy compound which is a reaction product of bisphenol A or bisphenol F with epichlorohydrin.

5. The lubricative composition as claimed in claim 1 wherein said first component is an amino-modified silicone oil, and said second component is a cyclic aliphatic epoxy compound.

6. A lubricative composition comprising component (a) which is a modified silicone oil having reactive organic groups and other organic groups that react with said reactive organic groups, and component (b) which is a lubricating oil or grease, said component (b) being retained in a three-dimensionally reticulated structure of silicone formed by polymerizing said component (a) in said component (b) said component (b) having no compatibility with said component (a).

7. The lubricative composition as claimed in claim 6 wherein the chemical equivalent of the reactive organic groups of said component (a) is set at 50–5000 g/mol.

8. The lubricative composition as claimed in claim 1 wherein the base oil of the lubricating oil or grease which is said third component is at least one selected from the group consisting of mineral oil, synthetic hydrocarbon oil, ester oil, ether oil, perfluoroalkylpolyether oil and phosphate ester oil.

9. The lubricative composition as claimed in claim 1 wherein the base oil of the lubricating oil or grease which is said third component is a mixture of at least one selected from the group consisting of mineral oil, low viscosity synthetic hydrocarbon oil, ester oil, ether oil, perfluoroalkylpolyether oil and phosphate ester oil, and a high-viscosity synthetic hydrocarbon oil having a viscosity at 40° C. of 1000 cSt or over.

10. The lubricative composition as claimed in claim 9 wherein said high-viscosity synthetic hydrocarbon oil is a carboxy-modified synthetic hydrocarbon oil.

11. The lubricative composition as claimed in claim 6 wherein the base oil of the lubricating oil or grease which is said component (b) is at least one selected from the group consisting of mineral oil, synthetic hydrocarbon oil, ester oil, ether oil, perfluoroalkylpolyether oil and phosphate ester oil.

12. The lubricative composition as claimed in claim 6 wherein the base oil of the lubricating oil or grease which is said component (b) is a mixture of at least one selected from the group consisting of mineral oil, low viscosity synthetic hydrocarbon oil, ester oil, ether oil, perfluoroalkylpolyether oil and phosphate ester oil, and a high-viscosity synthetic hydrocarbon oil having a viscosity at 40° C. of 1000 cSt or over.

13. The lubricative composition as claimed in claim 12 wherein said high-viscosity synthetic hydrocarbon oil is a carboxy-modified synthetic hydrocarbon oil.

* * * * *